US006083090A

United States Patent [19]

Bamba

[11] Patent Number: 6,083,090

[45] Date of Patent: Jul. 4, 2000

[54] POLISHING APPARATUS FOR SEMICONDUCTOR WAFERS

[75] Inventor: Ryo Bamba, Kyoto, Japan

[73] Assignee: Rohm Co., Ltd., Kyoto, Japan

[21] Appl. No.: 09/268,952

[22] Filed: Mar. 16, 1999

[30] Foreign Application Priority Data

Mar. 18, 1998 [JP] Japan ..... 10-067537

[51] Int. Cl.[7] ..... B24B 7/22

[52] U.S. Cl. ..... 451/288; 451/398; 451/388

[58] Field of Search ..... 451/288, 287, 451/388, 398, 41

[56] References Cited

U.S. PATENT DOCUMENTS 4,897,966 2/1990 Takahashi ..... 451/287
5,081,795 1/1992 Tanaka et al. ..... 451/398
5,443,416 8/1995 Volodarsky et al. ..... 451/388

FOREIGN PATENT DOCUMENTS 0156746 10/1985 European Pat. Off. ..... 451/388

*Primary Examiner*—Robert A. Rose
*Attorney, Agent, or Firm*—Majestic, Parsons, Siebert & Hsue P.C.

[57] ABSTRACT

A polishing apparatus for uniformly polishing the whole of a target surface of a semiconductor wafer includes a wafer holder for holding a wafer by adsorption and a pad to which the wafer holder is compressed while rotating. Between a rotary shaft for the apparatus and the wafer holder is a mechanism for allowing the orientation of the wafer holder to change with an increased degree of freedom. This mechanism is formed with a container filled with a liquid and attached to the lower end of the rotary shaft and an elastic member which seals the liquid in the container.

6 Claims, 2 Drawing Sheets

POLISHING APPARATUS FOR SEMICONDUCTOR WAFERS

BACKGROUND OF THE INVENTION

This invention relates to a polishing apparatus for making semiconductor wafers with uniform thickness.

ICs and LSIs are formed on refined high-purity silicon wafers. Such wafers are obtained by growing a silicon crystal along an axis and slicing the monocrystal (or single crystal) thus obtained. After a protecting film of silicon oxide is formed on such a silicon wafer, it is coated with a photosensitive resin called photoresist. After a wiring pattern is formed by photolithography, exposed portions of silicon oxide after the photosensitive resin has been removed are taken off by an etching process. An impurity material is diffused to produce impurity regions in the areas where silicon oxide has been removed and the surface of the silicon surface is exposed. If this is repeated many times, many layers of wiring pattern can be formed on the silicon wafer.

Such semiconductor wafers having many layers of wiring patterns formed on a silicon wafer are coming to be used frequently. Since differences in steps tend to appear among wafers if many layers of wiring patterns are formed continuously on a silicon wafer, it is a common practice to polish the surface of a semiconductor wafer (or its protective film of silicon oxide, to be more precise) every time silicon oxide serving as a protective film is formed.

Polishing apparatus of the type so-called chemical mechanical polishing (CMP) apparatus, as shown in FIG. 3, have been in use for polishing wafers having a rigid sphere 34 sandwiched between a top holder member 33*a* and a bottom holder member 33*b*. The top holder member 33*a* is connected to a rotary shaft 31 which is in turn connected to a motor (not shown) serving as a source of rotary motion. The top holder member 33*a* has throughholes 43 in which bolts 41 are inserted. The outer diameter of the bolts 41 is slightly less than the inner diameter of the throughholes 43. The bottom ends of the bolts 41 are in the form a screw 41*a* through which the top holder member 33*a* and the bottom holder member 33*b* are fastened together. A wafer holder 35 with a hollow interior 35*a* is attached to the bottom holder member 33*b* by means of screws 42 (only one shown). The wafer holder 35 has many suction openings 35*b* through which the hollow interior 35*a* is connected to the atmosphere outside.

The interior 35*a* of the wafer holder 35 is connected through a tube 36 to an externally disposed suction pump (not shown). A semiconductor wafer 37, to be polished, is adsorbed to the wafer holder 35 by activating this suction pump. For polishing a target surface of the wafer 37, the CMP apparatus is transported so as to place the adsorbed wafer 37 on a pad 38 with a rotary shaft (shown at 39 in FIG. 4), and both rotary shafts 31 and 39 of the apparatus and the pad 38, respectively, are rotated.

With the rotation of the rotary shaft 31, the top holder member 33*a* rotates around the solid sphere 34. The rotary motion of the top holder member 33*a* causes the bottom holder member 33*b* connected to the top holder member 33*a*, as well as the wafer holder 35 connected to the bottom holder member 33*b*, to start rotating similarly. Because of the space for movement (indicated by double-headed arrows in FIG. 3) between the solid sphere 34 and the bottom holder member 33*b*, as well as that between the throughholes 43 in the top holder member 33*a* and the bolts 41, the wafer holder 35 has a certain limited degree of freedom of motion. In other words, prior art CMP apparatus polish the entire target surface of a wafer by moving a wafer holder having this limited degree of freedom of motion.

The degree of freedom of motion for the wafer holder of a prior art CMP apparatus was not sufficiently large because it was limited by the range of motion of the bolts 41 in the throughholes 43 and that of the bottom holder member 33*b* with respect to the rigid sphere 34. While the top holder member 33*a* is rotating, the bolts 41 may sometimes contact the wall of the throughholes 43, thereby immobilizing the wafer holder 35. Because of the existence of the rigid sphere 34 in between, the applied pressure is not totally communicated to the wafer holder 35. As a result, the surface of the wafer adsorbed to the wafer holder may fail to contact the pad uniformly. In other words, the wafer will not be polished uniformly. In order to polish the wafer uniformly, it was necessary to increase the pressure to be applied.

SUMMARY OF THE INVENTION

It is therefore an object of this invention to provide a polishing apparatus capable of polishing a semiconductor wafer such that its thickness can be made uniform.

A polishing apparatus for a semiconductor wafer embodying this invention, with which the above and other objects can be accomplished, may be characterized not only as comprising a wafer holder for holding a wafer by adsorption and a pad to which the wafer holder is compressed while it is rotated, but also wherein a mechanism is provided between a rotary shaft for the apparatus and the wafer holder for allowing the orientation of the wafer holder to change with an increased degree of freedom. This mechanism is formed with a container filled with a liquid and attached to the lower end of the rotary shaft and an elastic member which seals the liquid in the container. The wafer holder is attached to only a portion of the lower surface of the elastic member such that the unattached portions of the elastic member are free to be deformed when pressure which is applied to the apparatus is propagated through the liquid in contact therewith. With a polishing apparatus thus structured, the whole of a target surface of a wafer to be polished can be contacted uniformly by the pad, as pressure is applied to the apparatus.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
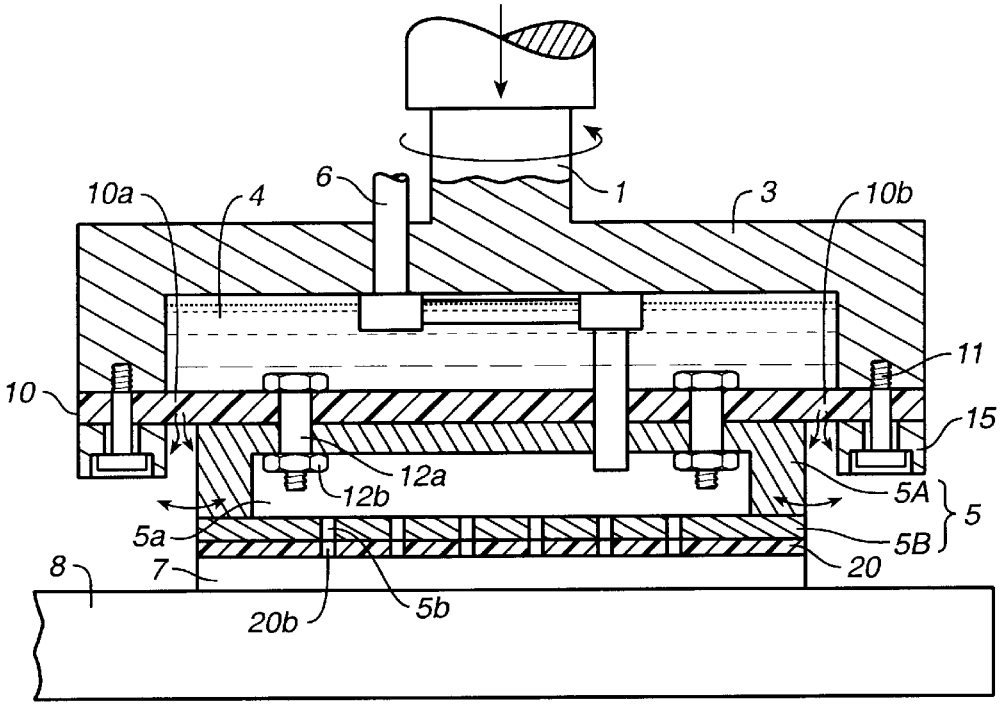
FIG. 1 is a schematic sectional view of a portion of a polishing apparatus for semiconductor wafers embodying this invention.

The invention is described next by way of an example with reference to the drawings. FIG. 1 shows a portion of a polishing apparatus (a CMP apparatus) embodying this invention, comprising a container 3 attached to a rotary shaft 1 which is in turn connected to a motor (not shown) serving as a power source for the apparatus. A liquid 4 is sealed inside the container 3 by means of an elastic member 10 which is attached not only to the edge of the downwardly facing opening of the container 3 by means of screws 11 with a ring 15 in between but also to a wafer holder 5 by means of bolts 12*a* and nuts 12*b*. The wafer holder 5 consists of a first circular disk-shaped member 5A with an indentation in the middle and a second circular disk-shaped member 5B connected together so as to form a hollow interior space 5*a* in between. The second member 5B has throughholes 5*b* therethrough and an elastic sheet 20 with throughholes 20*b* is pasted to the bottom surface of the second member 5B of the wafer holder 5 such that the throughholes 5*b* and 20*b* respectively through the elastic sheet 20 and the second member 5B of the wafer holder 5 match each other and hence that the interior space 5*a* of the wafer holder 5 is in an air-communicating relationship with the exterior. The hollow interior space 5*a* of the wafer holder 5 is connected to an externally disposed suction pump (not shown) through a tube 6 passing through the interior of the container 3 filled with the liquid 4. A semiconductor wafer 7, with a target surface to be polished, is adsorbed to the polishing head 5 through the elastic sheet 20 and is placed on top of a pad 8, transported by the CMP apparatus thus structured.

The wafer holder 5 is preferably made of a material which is sufficiently resistant against the heat generated by the polishing. From the points of view of heat resistance and insulating characteristic, ceramic materials are preferred for the wafer holder 5. As for the container 3, a material which does not rust, such as stainless steel, is preferred because it contains the liquid 4. The liquid 4 is for quickly propagating pressure to the elastic member 10. No particular requirements are imposed on its kind, except materials which may be corrosive to the container 3 or the elastic member 10 are not desirable. In view of the above, it may be said that water is the most suitable liquid for the purpose. The favorable material for the elastic member 10 is one capable of sealing the liquid 4 inside the container 3 and easily deformable by the pressure transmitted through the liquid 4. In view of the sealing characteristic and the elastic property, urethane rubber is preferred as the material for the elastic member 10. The elastic sheet 20 is used so as not to damage the semiconductor wafer 7 when a pressure is applied to the wafer holder 5. A urethane sheet is preferred, such as for the elastic member 10.

The semiconductor wafer 7 has many layers of wiring patterns and a protective membrane formed on a silicon wafer. The protective membrane serves not only to protect the surface of the silicon wafer but also as an insulating layer. From the points of view of fabrication and workability of the membrane, silicon oxide is a preferred material.

The pad 8 comprises a urethane resin and has grooves (not shown) formed on its polishing surface. These grooves serve to abrade the target surface of the semiconductor wafer 7.

An example of routine for polishing a semiconductor wafer, by using the CMP apparatus as explained above, will be described next.

Figure 2:
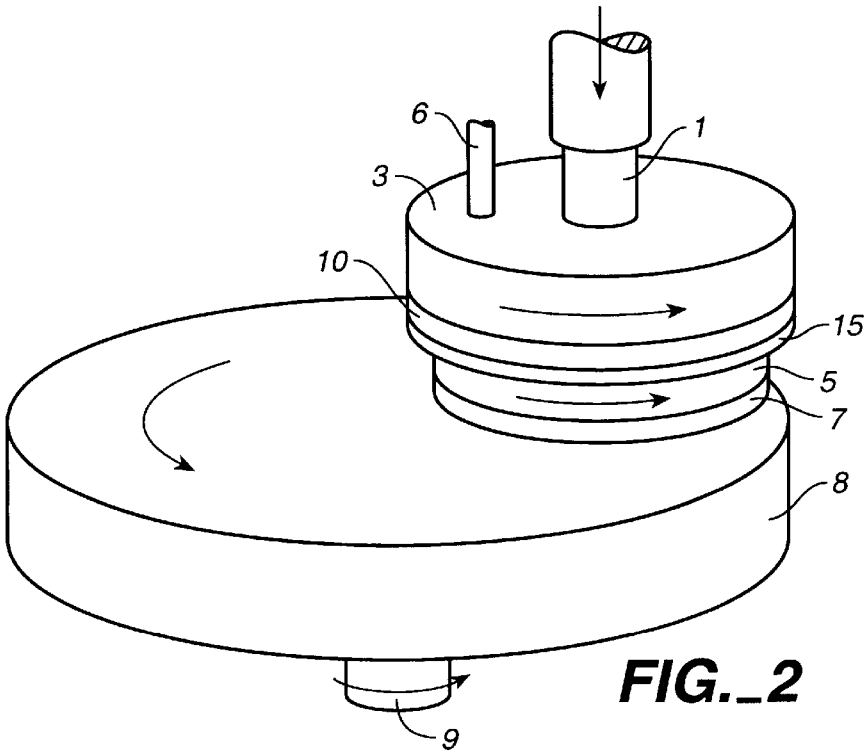
FIG. 2 is a schematic diagonal view of the polishing apparatus of FIG. 1 when a semiconductor wafer is being polished thereby.
Figure 3:
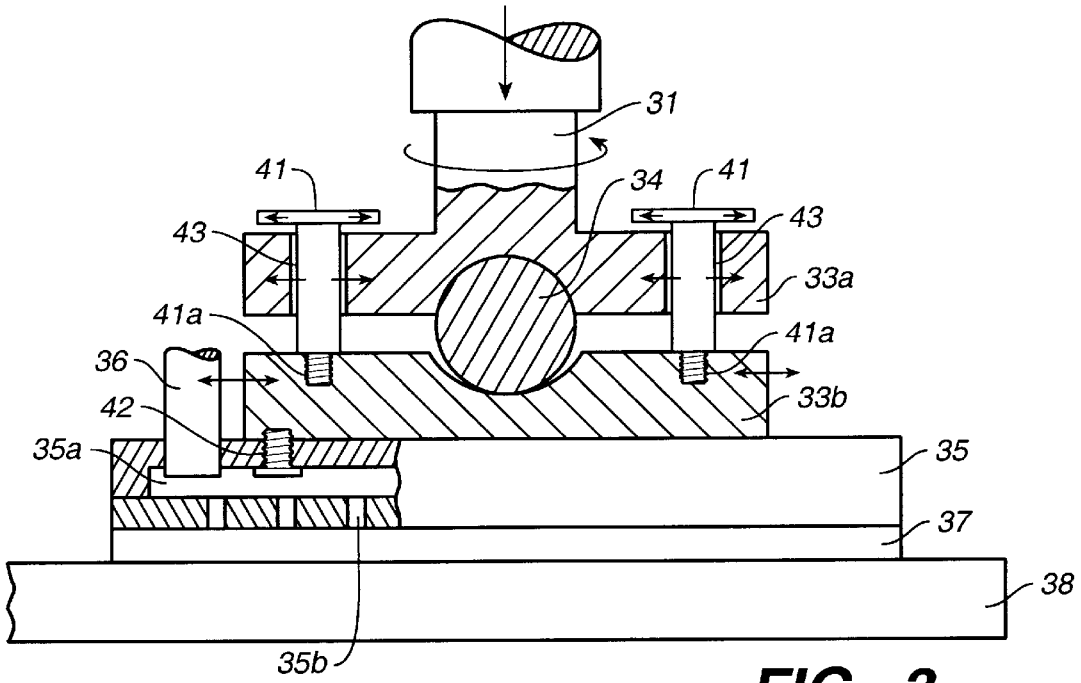
FIG. 3 (PRIOR ART)
FIG. 3 is a schematic sectional view of a portion of a prior art polishing apparatus for semiconductor wafers.
Figure 4:
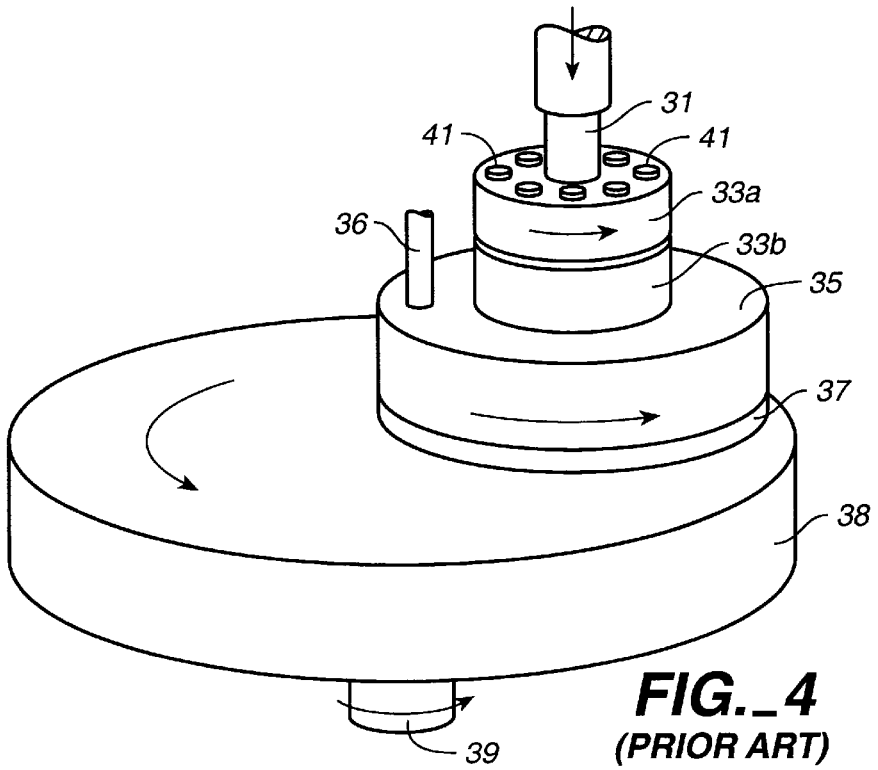
FIG. 4 (PRIOR ART)
FIG. 4 is a schematic diagonal view of the prior art polishing apparatus of FIG. 3 when a semiconductor wafer is being polished thereby.

The suction pump (not shown) is activated first to have the semiconductor wafer 7 adsorbed through the elastic sheet 20 to the wafer holder 5. When it is to be polished, the CMP apparatus is transported in order to place the adsorbed wafer 7 on the pad 8 and a pressure is applied on the CMP apparatus, as indicated by a vertical arrow in FIGS. 1 and 2. The rotary shaft 1 of the CMP apparatus and the shaft 9 (not collinear with the rotary shaft 1, as shown in FIG. 9) of the pad 8 are both rotated, as indicated by arrows in FIG. 2, to polish the wafer 7 with the pad 8.

A load cell may be used to apply a pressure of about 250 g/cm$^2$ from above to compressed the wafer 7 against the pad 8. This pressure is transmitted to the liquid 4 filling the container 3. Since the liquid 4 has a large degree of freedom, the elastic sheet 10 pasted onto the container 3 is quickly compressed. The elastic member 10 would be deformed accordingly because it is made of a flexible material but the portions attached to the wafer holder 5 cannot be deformed. Unattached portions 10*a* and 10*b* of the elastic sheet 10, however, will be deformed by the pressure communicated through the liquid 4, and this causes the wafer holder 5 to move and/or allows it to change its orientation. Since these unattached portions 10*a* and 10*b* of the elastic member 10 can move in any direction, the degree of freedom of motion of the wafer holder 5 is increased. Thus, the wafer holder 5 can orient itself such that the whole of the target surface of the semiconductor wafer 7 to be polished can be uniformly contacted to the pad 8. As a result, no step differences will be generated on the wafer surface, and a wafer with uniform thickness can be obtained. Thus, the container 3, the liquid 4 and the elastic member 10 may be together considered to form an orientation varying means for providing an increased degree of freedom of motion, or ability to change the orientation of the wafer holder 5.

As the rotary shaft 1 is rotated, the container 3 is also rotated and both the elastic member 10 and the wafer holder 5 attached to the elastic member 10 start to rotate similarly. If a polishing agent in the form of a slurry is applied to the pad 8 and the rotational speed of the wafer holder 5 is made slightly different from that of the pad 8, the design of the grooves (not shown) formed on the pad 8 will not appear on the surface of the wafer 7. Such a polishing agent may be selected for its ability to polish the protective layer on the surface of the semiconductor wafer 7. If the protective layer comprises silicon oxide, a mixture of potassium hydroxide and silica may be used as the polishing agent.

Although the invention was described above with reference to only one example of the embodiment, this example is not intended to limit the scope of the invention. Many modifications and variations are possible within the scope of the invention. For example, the polishing apparatus of this invention may be used for polishing not only a semiconductor wafer comprising a silicon wafer but also semiconductor wafers comprising other materials such was germanium wafers or semiconductor wafers using a gallium-arsenic wafer as substrate. Furthermore, the polishing apparatus of this invention may be used also for polishing objects other than semiconductor wafers. Materials such as metallic pieces and wood materials can be polished by a polishing apparatus embodying this invention. In summary, all such modifications and variations that may be apparent to a person skilled in the art are intended to be within the scope of this invention.

What is claimed is:

1. A polishing apparatus for polishing a target surface of a wafer, said apparatus comprising:

a rotary shaft having a lower end;

a wafer holder for holding a wafer by adsorption, said wafer holder being connected to said rotary shaft;

a pad against which said wafer holder is adapted to compress the wafer while rotating around said rotary shaft;

orientation varying means disposed between said rotary shaft and said wafer holder for varying orientation of said wafer holder and thereby causing the target surface of the wafer to contact said pad uniformly, said orientation varying means including:

a container which is attached to said lower end of said rotary shaft and has an interior space opening downward;

a liquid with which said interior space of said container is filled; and an elastic member attached to said wafer holder and to said container so as to seal in said liquid in said interior space of said container.

2. The polishing apparatus of claim 1 wherein said wafer holder has a lower surface provided with throughholes.

3. The polishing apparatus of claim 2 wherein said wafer holder has a hollow interior to which said throughholes are open, said hollow interior being connected to an external suction pump through a tube which passes through said interior space of said container.

4. The polishing apparatus of claim 3 further comprising an elastic sheet which is attached to a lower surface of said wafer holder.

5. The polishing apparatus of claim 1 wherein said elastic member has a lower surface, said wafer holder being attached to only a portion of said lower surface, wherein there are portions of said lower surface of said elastic member that can move due to pressure propagating through said liquid.

6. The polishing apparatus of claim 1 wherein said elastic member supports said liquid thereupon.

* * * * *